US010932068B2

(12) United States Patent
Meskens et al.

(10) Patent No.: US 10,932,068 B2
(45) Date of Patent: Feb. 23, 2021

(54) POWER AND SIGNAL TRANSMISSION DEVICES FOR AUDITORY PROSTHESIS

(71) Applicant: COCHLEAR LIMITED, Macquarie University (AU)

(72) Inventors: Werner Meskens, Macquarie University (AU); Oliver John Ridler, Macquarie University (AU)

(73) Assignee: COCHLEAR LIMITED, Macquarie University (AU)

( * ) Notice: Subject to any disclaimer, the term of this patent is extended or adjusted under 35 U.S.C. 154(b) by 984 days.

(21) Appl. No.: 14/042,954

(22) Filed: Oct. 1, 2013

(65) Prior Publication Data

US 2015/0092969 A1 Apr. 2, 2015

(51) Int. Cl.
*H04R 25/00* (2006.01)

(52) U.S. Cl.
CPC ..... *H04R 25/602* (2013.01); *H04R 25/606* (2013.01); *H04R 25/554* (2013.01); *H04R 25/556* (2013.01); *H04R 2460/13* (2013.01)

(58) Field of Classification Search
CPC ..... H04R 25/602; H04R 2225/61; H04R 2225/31; H04R 2225/021
See application file for complete search history.

(56) References Cited

U.S. PATENT DOCUMENTS

| | | | | |
|---|---|---|---|---|
| 6,272,382 | B1 * | 8/2001 | Faltys | A61N 1/08 607/57 |
| 8,177,112 | B1 * | 5/2012 | Crawford | A45F 5/02 224/666 |
| 8,270,647 | B2 | 9/2012 | Crawford et al. | |
| 2004/0049243 | A1 * | 3/2004 | Seligman | A61N 1/36032 607/57 |
| 2008/0298627 | A1 * | 12/2008 | Bonebright | H04M 1/03 381/386 |
| 2013/0049675 | A1 * | 2/2013 | Minami | H02J 7/0054 320/103 |

* cited by examiner

*Primary Examiner* — Nafiz E Hoque

(57) ABSTRACT

An auditory prosthesis can be powered by an on-board battery that is placed into a receptacle in the auditory prosthesis. When longer battery life is desired, a recipient can selectively utilize a discrete power supply to power the auditory prosthesis. The discrete power supply provides power to the auditory prosthesis and, in certain embodiments, has a longer life than the on-board battery. The discrete power supply includes an adapter having a form factor that mates with the battery receptacle on the auditory prosthesis.

1 Claim, 12 Drawing Sheets

POWER AND SIGNAL TRANSMISSION DEVICES FOR AUDITORY PROSTHESIS

BACKGROUND

Auditory prostheses, such as cochlear implants, include an implantable portion having a stimulating assembly and an external portion having speech processing hardware and software, as well as a battery. The battery provides power to the external portion so as to enable the appropriate signals to be sent to the implantable portion. In certain prostheses, the battery also powers the implantable portion. As the battery discharges, it becomes necessary for a recipient to change or recharge the battery. The lifespan of the battery depends on the use of the auditory prosthesis.

SUMMARY

Embodiments disclosed herein relate to systems, methods, and apparatuses that are used to provide power to medical devices. Those devices include, for example, cochlear implants or other auditory prostheses or devices. The external portion of the auditory prosthesis is powered by a small on-board battery that is placed into a receptacle in the auditory prosthesis. When longer battery life is required, the recipient can selectively utilize a separate, discrete power supply to power the auditory prosthesis. The discrete power supply provides power to the auditory prosthesis and, in certain embodiments, has a longer life than the on-board battery. The separate, discrete power supply includes an adapter having a form factor that mates with the battery receptacle on the auditory prosthesis. Thus, no discrete plug (for example, a male plug to a female receptacle) is required.

This summary is provided to introduce a selection of concepts in a simplified form that are further described below in the Detailed Description. This summary is not intended to identify key features or essential features of the claimed subject matter, nor is it intended to be used to limit the scope of the claimed subject matter.

BRIEF DESCRIPTION OF THE DRAWINGS

The same number represents the same element or same type of element in all drawings.

DETAILED DESCRIPTION

Figure 1:
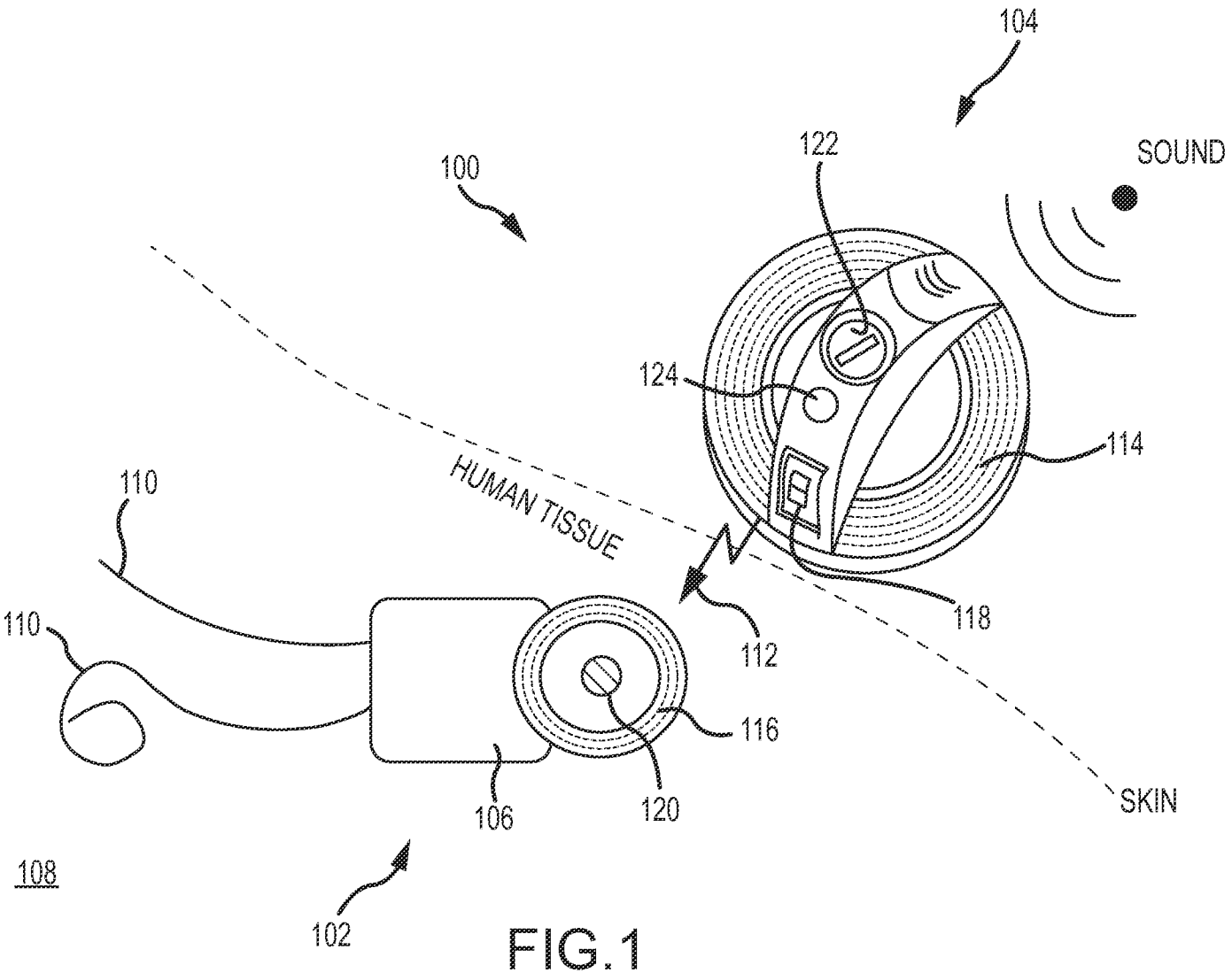
FIG. 1 is a perspective view of an embodiment of an auditory prosthesis, including an implantable portion and an external portion.

While the technologies disclosed herein have particular application in the cochlear implant devices depicted in FIG. 1, it will be appreciated that the systems, methods, and apparatuses disclosed can be employed to provide power to other types of hearing prostheses. For example, the embodiments disclosed herein can be used to power traditional hearing aids, hearing prostheses, active transcutaneous bone conduction devices, passive transcutaneous devices, middle ear devices, or other devices that include an external battery. Furthermore, the embodiments disclosed herein can be utilized to power medical devices other than hearing prostheses. The technologies disclosed herein will be described generally in the context of external portions of medical devices where the external portions contain batteries. Certain aspects of the technology however, for example, the external portions of a cochlear implant identified in FIG. 1, are described in the context of auditory prostheses. Power provided to the devices depicted herein by an on-board battery is generally described herein as internal power. Power provided to the devices by an external power source is referred to herein as external power.

FIG. 1 is a perspective view of an embodiment of an auditory prosthesis 100, in this case, a cochlear implant, including an implantable portion 102 and an external portion 104. The implantable portion 102 of the cochlear implant includes a stimulating assembly 106 implanted in a body (specifically, proximate and within the cochlea 108) to deliver electrical stimulation signals to the auditory nerve cells, thereby bypassing absent or defective hair cells. The electrodes 110 of the stimulating assembly 106 differentially activate auditory neurons that normally encode differential pitches of sound. This stimulating assembly 106 enables the brain to perceive a hearing sensation resembling the natural hearing sensation normally delivered to the auditory nerve.

The external portion 104 includes a speech processor that detects external sound and converts the detected sound into a coded signal 112 through a suitable speech processing strategy. The coded signal 112 is sent to the implanted stimulating assembly 106 via a transcutaneous link. In one embodiment, the signal 112 is sent from a coil 114 located on the external portion 104 to a coil 116 on the implantable portion 102. The stimulating assembly 106 processes the coded signal 112 to generate a series of stimulation sequences which are then applied directly to the auditory nerve via the electrodes 110 positioned within the cochlea 108. The external portion 104 also includes a battery and a status indicator 118. Permanent magnets 120, 122 are located on the implantable portion 102 and the external portion 104, respectively. In the depicted embodiment, the external portion includes a microphone port 124 connected to a microphone that receives sound. The microphone is connected to one or more internal processors that process and convert the sound into stimulation signals that are sent to the implantable portion 102.

Figure 2:
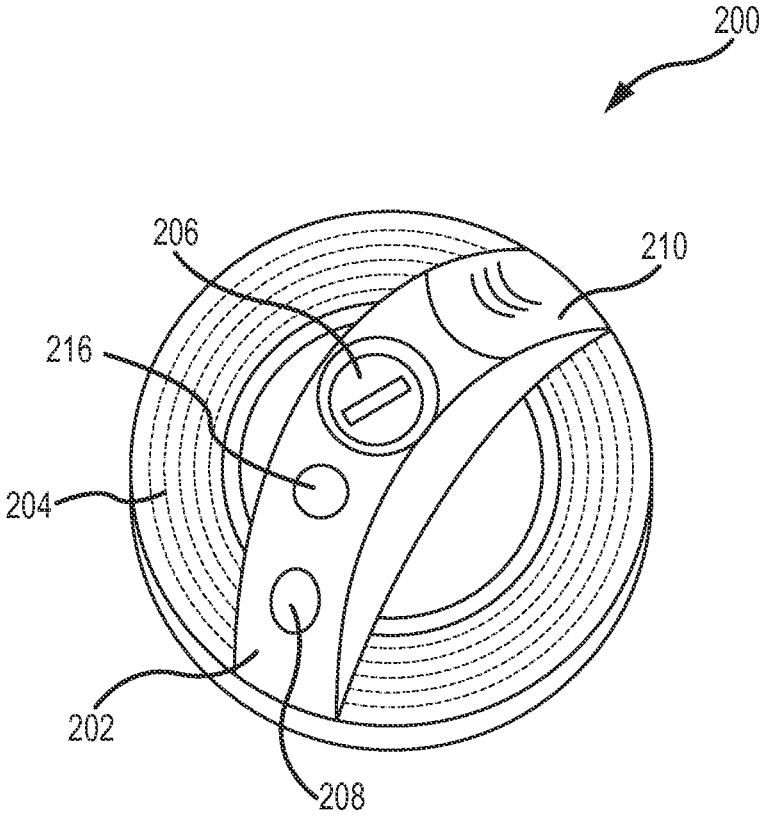
FIGS. 2-3 are perspective views of an external portion of an auditory prosthesis.
Figure 3:
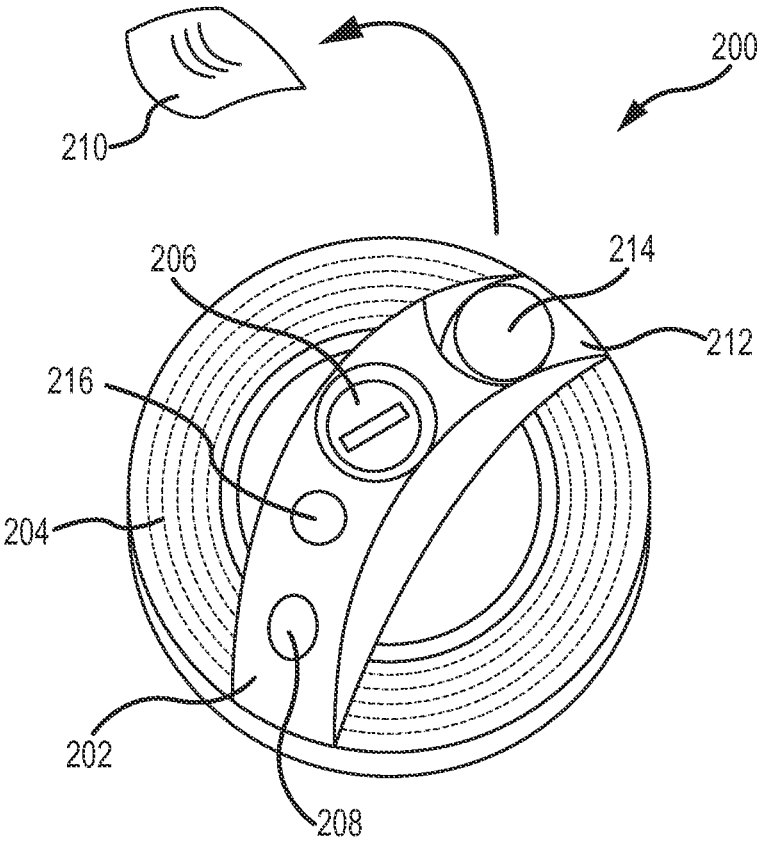

FIGS. 2-3 are perspective views of an embodiment of an external portion 200 of an auditory prosthesis and are described simultaneously. The external portion 200 includes a body 202 and a coil 204 connected thereto. The body 202 can include a permanent magnet 206 as described above. The external portion 200 can include an indicator 208 such as a light emitting diode (LED). A battery door 210 (depicted removed in FIG. 3) covers a receptacle 212 that includes a battery 214 that provides internal power to the various components of the external portion 200 and the implantable portion. The battery 214 is matingly received in the receptacle 212. The battery 214 can be removed when battery life is expended or otherwise as desired by a recipient. A microphone 216 receives sound that is processed by components within the external portion 200.

Figure 4:
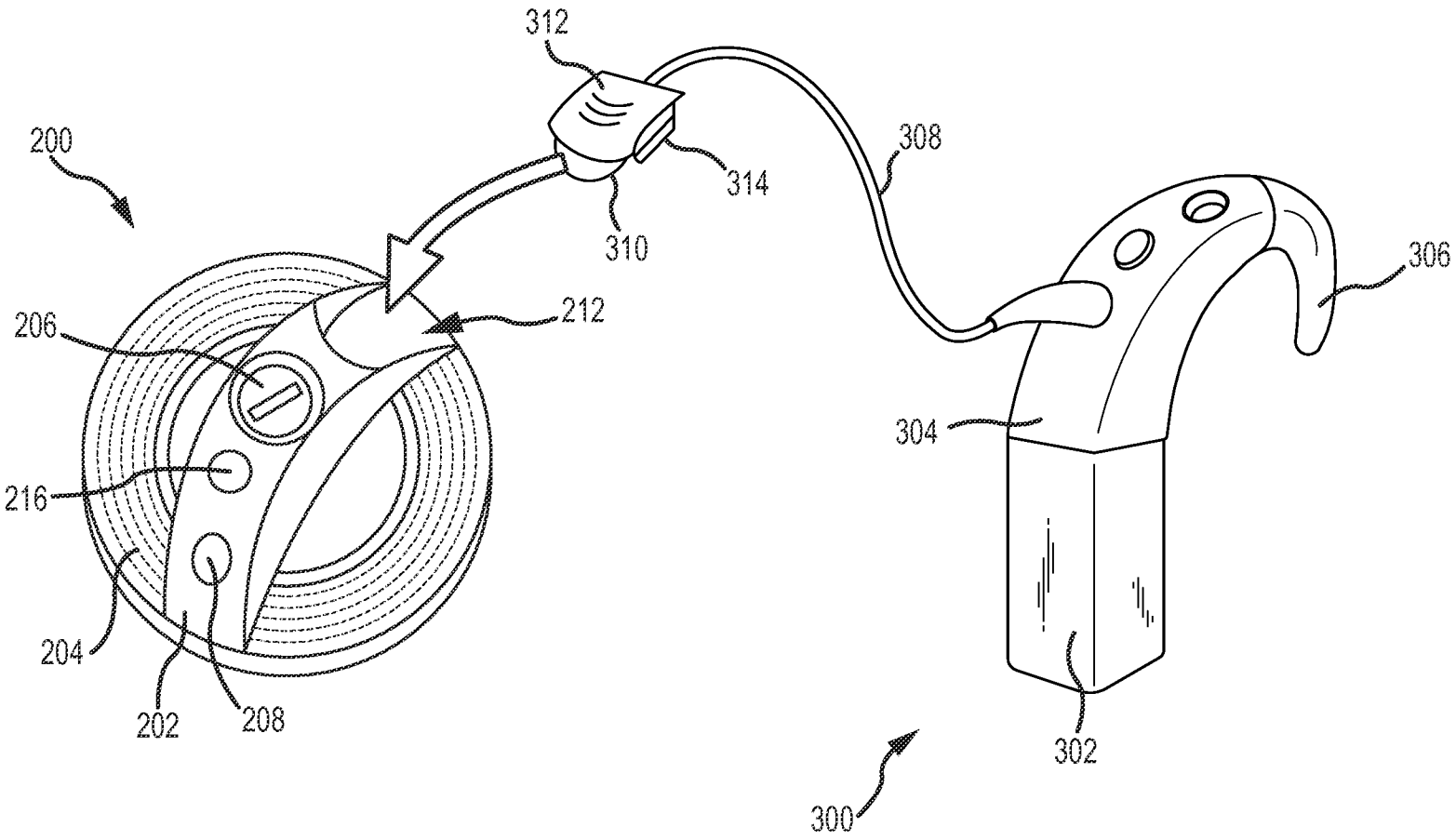
FIGS. 4-5 are perspective views of an external portion of an auditory prosthesis utilizing an embodiment of a discrete power source.
Figure 5:
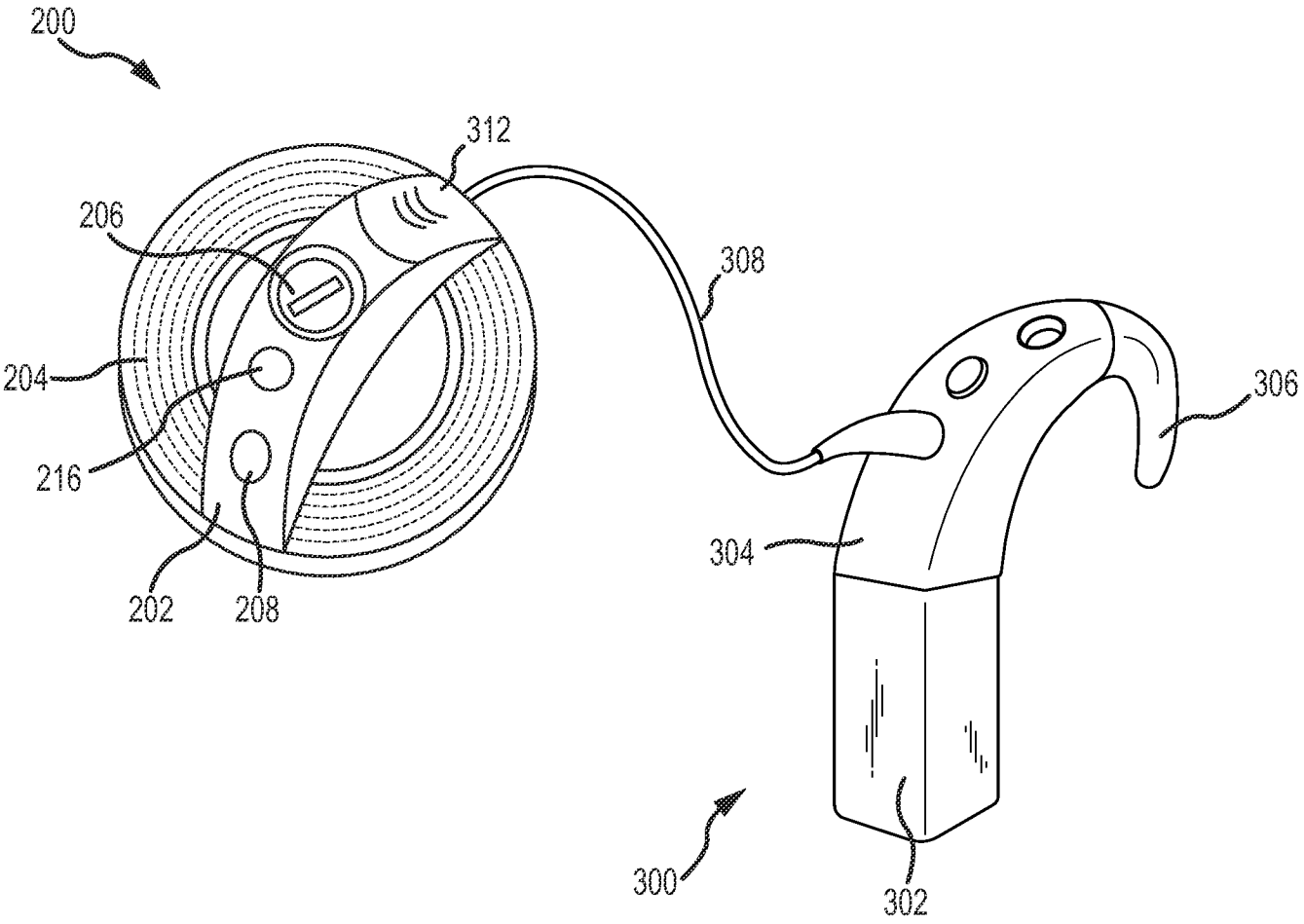

FIGS. 4-5 are perspective views of the external portion 200 of the auditory prosthesis of FIGS. 2 and 3 utilizing an embodiment of a discrete power source 300. FIGS. 4 and 5 are described simultaneously. The depicted hearing device 302 includes a housing 304 and an ear hook 306 that helps locate the device 302 on a recipient's ear. Additionally, the hearing device 302 can include a battery that powers the various components of the hearing device 302. When external power is desired for the external portion 200, a recipient can connect the external portion 200 to the hearing device 300, via a cable 308. The cable 308 is connected to an adapter 310 that is matingly received in the receptacle 212. Accordingly, the adapter 310 has a form factor substantially similar or identical to the battery 214. Similarities in form factors are described in more detail below. In the depicted embodiment, a cover 312 is connected to the cable 308. The cover 312 covers the receptacle 212 (FIG. 4) to prevent dirt, debris, moisture, etc., from entering therein when the adapter 310 is providing external power to the external portion 200. The cover 312 can include a gasket 314 or other sealing implement to ensure a water-tight seal.

Figure 6:
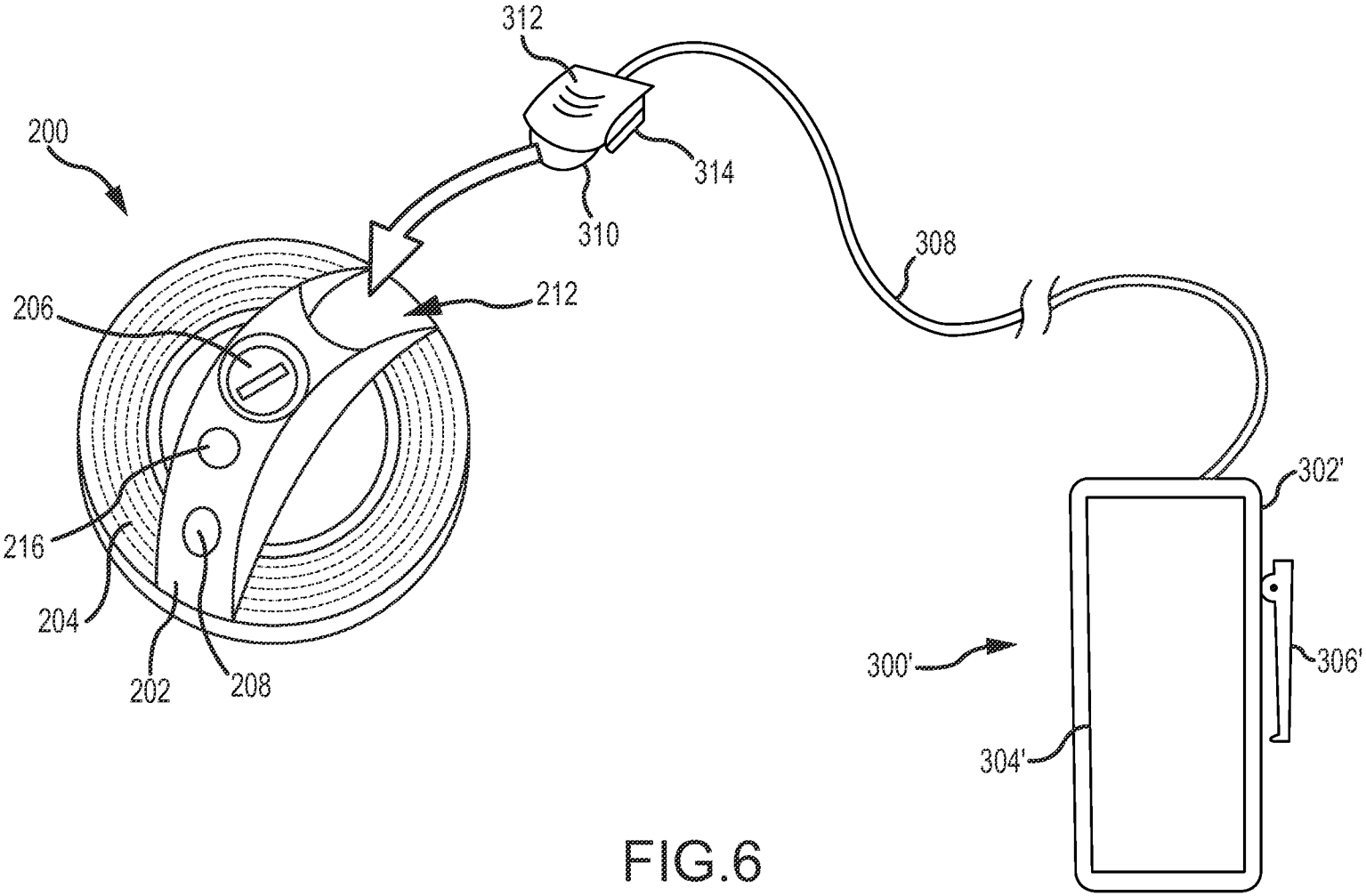
FIGS. 6-7 are perspective views of an embodiment of an external portion of an auditory prosthesis utilizing another embodiment of a separate, discrete power source.
Figure 7:
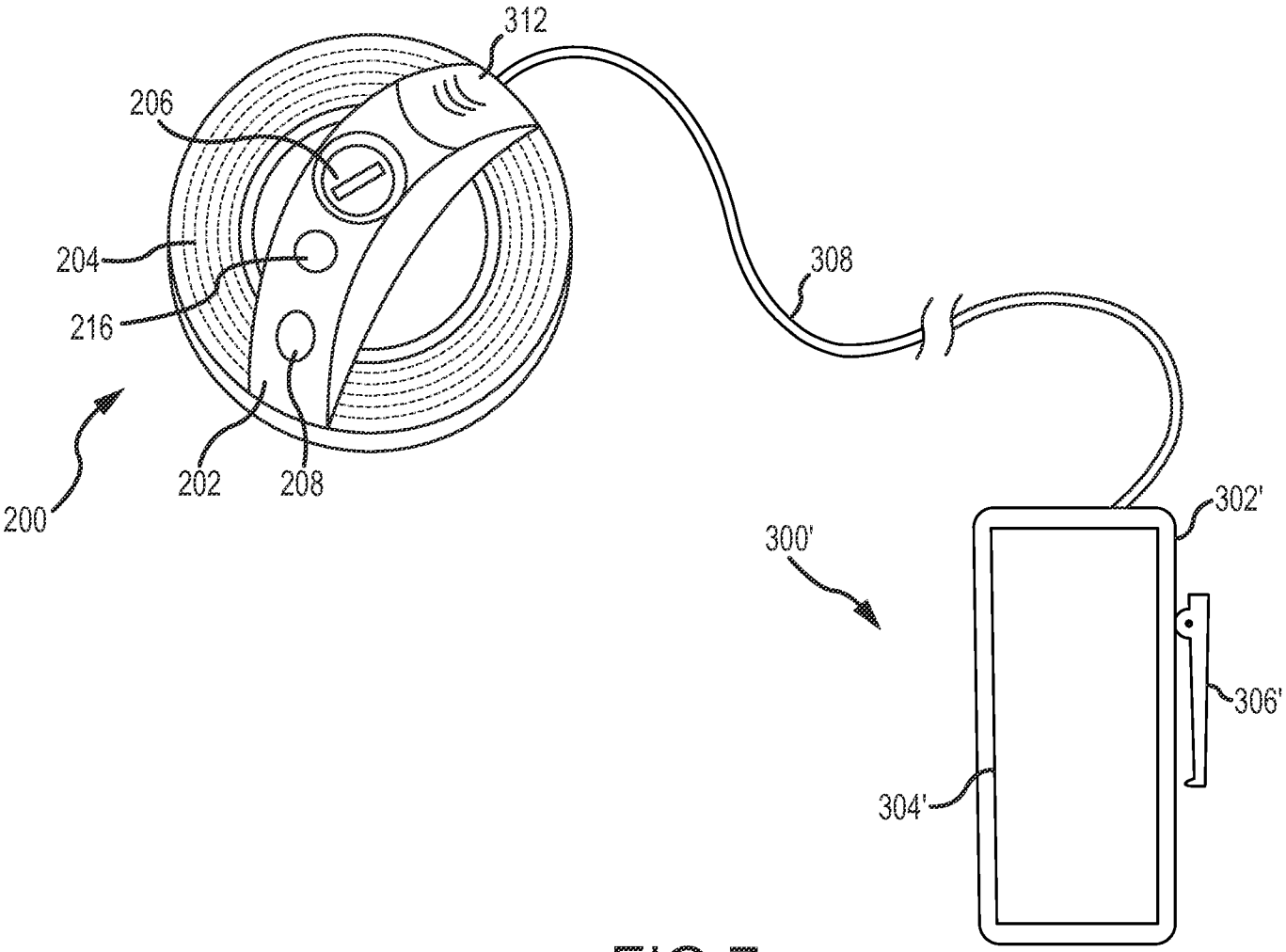

FIGS. 6-7 are perspective views of the external portion 200 of an auditory prosthesis of FIGS. 2 and 3 utilizing another embodiment of a separate, discrete power source 300'. FIGS. 6 and 7 are described simultaneously, and components common to the embodiment depicted in FIGS. 2-5 are not described further, unless otherwise noted. In this embodiment, the discrete power source 300' is a battery pack 302'. The battery pack 302' includes a housing 304' and a clip 306' that allows the battery pack 302' to be worn on an article of clothing, such as pants, a belt, a shirt pocket, etc. Accordingly, the cable 308 is depicted broken to indicate that the cable 308 can be a length sufficient to reach the external portion 200, regardless of where the battery pack 302' is worn on the recipient.

The embodiments of auditory prostheses described herein that utilize both internal power and external power via the same receptacle, display numerous advantages previously unrealized in the art. For example, internal power sources are typically smaller batteries (for example, lightweight zinc-air batteries). Such batteries display an electrical charge of about 400-500 mAh (e.g., size "675" zinc-air batteries), which can be sufficient to power an external portion of an auditory prosthesis for a time period of about 10 to about 16 hours (depending on usage). External power sources, in contrast, display significantly higher capacity and can last for days. For example, a common AAA battery displays an electrical charge of about 1000 mAh, while an AA battery displays an electrical charge of about 2500 mAh. Thus, a recipient of an auditory prosthesis can choose to use the appropriate battery for a particular application or duration. A recipient can, for example, utilize the external power source on longer trips where changing an internal battery can be impractical or not feasible.

A recipient can also choose to utilize the internal power source during certain social situations where the recipient can be self-conscious about his or her auditory prosthesis. For example, at home or around people with whom the recipient has a high comfort level, the recipient can choose to utilize the longer-lasting external power source, even though the cord connecting the battery unit to the external portion is visible to others. When in social or work situations, however, the recipient can choose to utilize internal power, to limit the visibility of his or her auditory prosthesis. The cable connecting the battery pack to the external portion of the auditory prosthesis can prevent the external portion from being lost, especially during activities when the external portion can release from magnetic contact with the internal portion of the auditory prosthesis. Inadvertent release can occur most commonly during swimming, other watersports, or other vigorous activities. Additionally, larger batteries that are utilized in a separate, discrete battery unit are generally less expensive and typically are easier to obtain than smaller zinc-air batteries. This can be useful when a recipient is travelling to a less-developed country but still requires use of his or her auditory prosthesis.

Figure 8A:
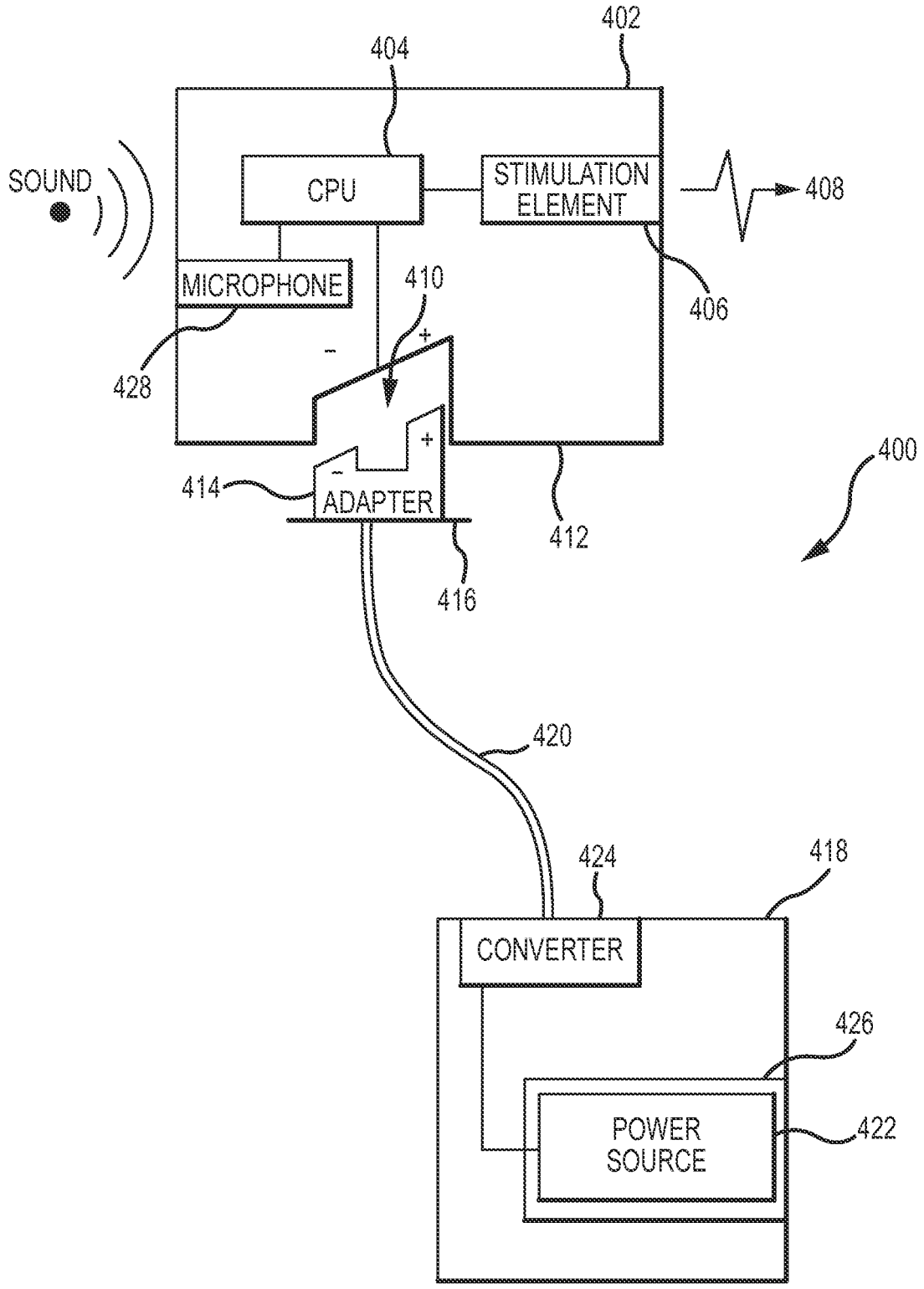
FIG. 8A is a schematic representation of an embodiment of an auditory prosthesis utilizing a separate, discrete power source.

FIG. 8A is a schematic representation of an embodiment of an auditory prosthesis 400 having a separate, discrete power supply. More specifically, the auditory prosthesis 400 includes an external portion 402 that includes a processor 404. Sound is received by a microphone 428 and sent to the processor 404. The processor 404 includes sound processing components and sends a signal to a transmission unit 406, which in turn sends an output signal 408 to a recipient. The output signal 408 can be in the form of a direct stimulus (e.g., a vibration stimulus sent to a connected implanted bone conduction device) or a signal (e.g., a wireless signal sent to a cochlear implant, which in turn provides an electrical stimulus to the cochlea). A battery receptacle 410 is defined by a housing 412 of the external portion 402. An adapter 414 is configured to be matingly received in the receptacle 410 and includes an integral cover 416 to seal the receptacle 410 when the adapter 414 is utilized. The adapter 414 has a form factor similar to that of the receptacle 410. Utilizing a similar form factor allows the adapter 414 to remain properly positioned within the receptacle 410, such that the adapter contacts remain positioned relative to the receptacle terminals. Indeed, contact/terminal alignment is one aspect of form factor similarity that should be maintained to ensure proper operation.

The adapter 414 is connected to a battery unit 418 discrete from the housing 412 with a cable 420. The battery unit 418 includes a power source 422, which can be a battery as described above. The power source 422 is disposed within a receptacle 426 that can be opened. Thus the power source 422 can be replaced with a new power source when power is expended. As described above, it is generally desirable that the power source 422 of the battery unit 418 be of a higher capacity than a battery that would be received in the battery receptacle 410. Accordingly, the battery unit 418 includes a converter or circuit 424 that converts the output power from the power source 422 into power that is usable by the external portion 402. Such a converter 424 can, for example, modify or regulate the output voltage, current, etc., as required or desired for the particular external device 402. Such modification or regulation can include, for example, a reduction or increase in voltage and/or current. In certain embodiments, an outer housing of the battery unit 418 is a water-tight structure.

Figure 8B:
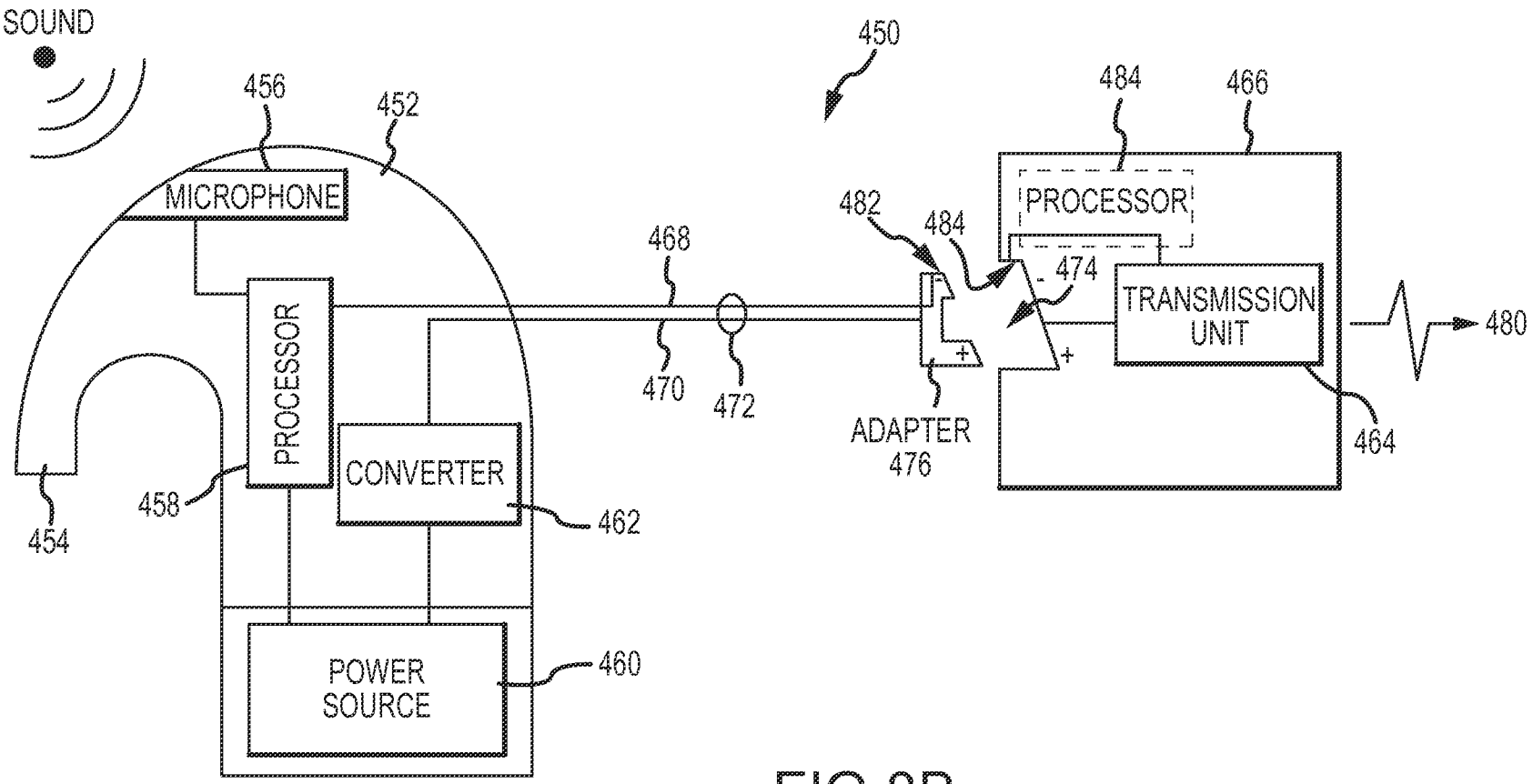
FIG. 8B is a schematic representation of another embodiment of an auditory prosthesis utilizing a separate, discrete power source.

FIG. 8B is a schematic representation of another embodiment of an auditory prosthesis 450 having a separate, discrete power supply. In this embodiment, the auditory prosthesis 450 includes a device 452 worn on the recipient's ear, utilizing an earhook 454. A microphone 456 receives sound and sends that received sound to a processor 458 for processing. A power source (e.g., a battery) 460 is received within the device 452 and provides power to the processor 458. Power from the power source 460 is also converted by a converter 462, which operates as described above. The processor 458 sends a signal to a transmission unit 464 located, in this case, in an external portion 466 attached to a recipient's skull. This signal is sent via a transmission cable 468. Power from the converter 462 is sent via a power cable 470. Both the transmission cable 468 and power cable 470 can be contained within a single cable housing or sheath 472. The external portion 466 defines a receptacle 474 configured to receive an adapter 476, as described above. The adapter 476 includes power contacts that mate with power terminals within the receptacle 474 to provide power to the components of the external portion 466 (e.g., the transmission unit 464). In this embodiment, the transmission unit 464 is configured to transmit an output signal 480, as described above, to a recipient. In addition to providing power from a discrete device 452, the auditory prosthesis 450 of FIG. 8B also sends signals from the device 452 to the external portion 466. In this case, the adapter 476 includes one or more signal contacts 482 that mate with receptacle terminals 484 in the receptacle 474. In this configuration, output signals from the processor 458 are sent to the transmission unit 464. Other types of signals may be sent between the device 452 and the external portion 466 via the transmission cable 468 and adapter 476, in either direction.

The technologies described herein can be used to provide power, via an adapter, to a battery-operated device via that device's battery receptacle. Accordingly, the external power source can be building power as typically available from a wall outlet. In such cases, a converter that converts AC power to DC power can be utilized to ensure the proper power is available at the device. Alternatively, the power source can be obtained from an accessory port located in a motor vehicle. In this case the converter converts the DC power signal to the appropriate input level of the device. The adapters can also allow power from scavenging energy power sources, such as solar power, kinetic energy, or thermal energy, to be utilized in conjunction with a device that is typically battery-powered. Again, a converter can convert the scavenged power to an appropriate input level to power the device, via an adapter received in a battery receptacle. Returning to FIG. 8, an alternative embodiment of the auditory prosthesis contemplates the converter being disposed in the external portion 402 as a discrete unit or part of the CPU 404. Additionally, the converter can be disposed in the adapter 414 itself.

Figure 9B:
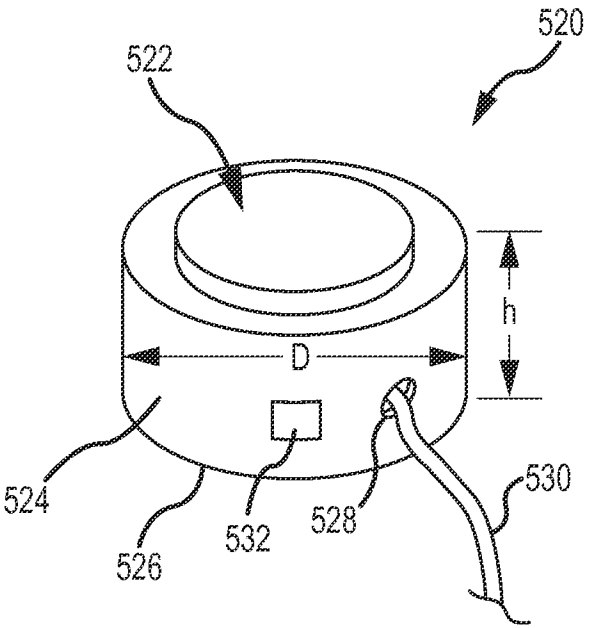
FIGS. 9B-9C depict embodiments of adapters.
Figure 9A:
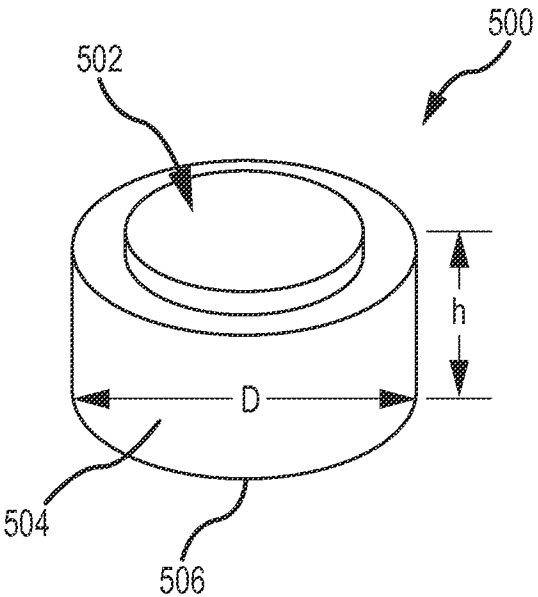
FIG.9A (PRIOR ART)
FIG. 9A depicts a prior art power source.
Figure 9C:
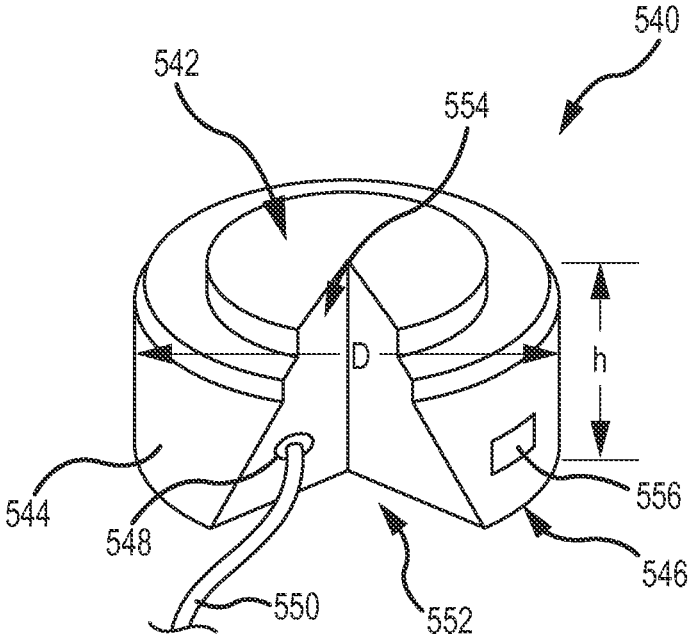

As described above, the adapters described herein allow power from an external battery to be used with a device that receives an internal battery, even though the external and internal batteries have different form factors. In that regard, the adapters have a form factor identical or substantially similar to the form factor of the internal power source. In this regard, FIG. 9A depicts a prior art power source, in this case, a zinc-air battery 500, that would be used to provide internal power to an auditory prosthesis. Commercial zinc-air batteries are typically short cylindrical bodies having a height h and a diameter D, as indicated in FIG. 9A. The battery 500 includes a negative contact surface 502 and a positive contact surface 506 defines the height h. A case 504 typically defines the diameter D, and the distance from the negative contact surface 502 to the positive contact surface 506. FIGS. 9B and 9C depict embodiments of adapters 520, 540 that can be utilized in a receptacle that typically receives the zinc-air battery 500 depicted in FIG. 9A. With regard to the adapter 520 of FIG. 9B, a case 524 defines a diameter D substantially similar to the diameter D of the battery 500. Additionally, a negative contact surface 522 and a positive contact surface 526 define a height h that is substantially similar to the height h of the battery 500 so as to ensure proper contact with the receptacle terminals. In that regard, the form factors of the battery 500 and adapter 520 are substantially similar, thus allowing the adapter 520 to be matingly received in a receptacle that receives the battery 500. At least a portion of an outer surface of the adapter 520 defines an opening 528 for receiving a cable 530 that is routed from the external power source. In this embodiment, the case 524 defines the opening 528, but other embodiments contemplate the opening through one of the two contact surfaces 522, 526. In embodiments where transmission signals are sent via the adapter 520 (such as described in FIG. 8B), one or more signal contacts 532 can be located on the case 524.

FIG. 9C depicts another embodiment of an adapter 540. In this embodiment, a case 544 defines a diameter D substantially similar to the diameter D of the battery 500. Additionally, a negative contact surface 542 and a positive contact surface 546 define a height h that is substantially similar to the height h of the battery 500. In that regard, the form factors of the battery 500 and adapter 540 are substantially similar, thus allowing the adapter 540 to be matingly received in a receptacle that receives the battery 500. This adapter includes a cut-out 552 through which a cable 550 is routed to an opening 548 in an inner surface 554 of the cut-out 552. The cut-out 552 enables the cable 550 to be routed so as to avoid interference with the receptacle, which can occur if the adapter is fit tightly within the receptacle. In this case, the form factor of the adapter 540 and battery 500 are still similar, in that the negative contact surface 542 and positive contact surface 546 are still disposed so as to contact the appropriate terminals within the receptacle, so as to deliver power to the device. In embodiments where transmission signals are sent via the adapter 540 (such as described in FIG. 8B), one or more signal contacts 556 can be located on the case 544. Other shapes of adapters are contemplated, depending on the internal power source that is being replaced. For example, depending on the device used, the adapter can be configured and sized to have a form factor that resembles one or more of the following types of batteries: AA, AAA, AAAA, 9-volt, 4.5-volt, A23, CR2032, LR44, A, B, C, D, or other types of standard or custom batteries.

Figure 10:
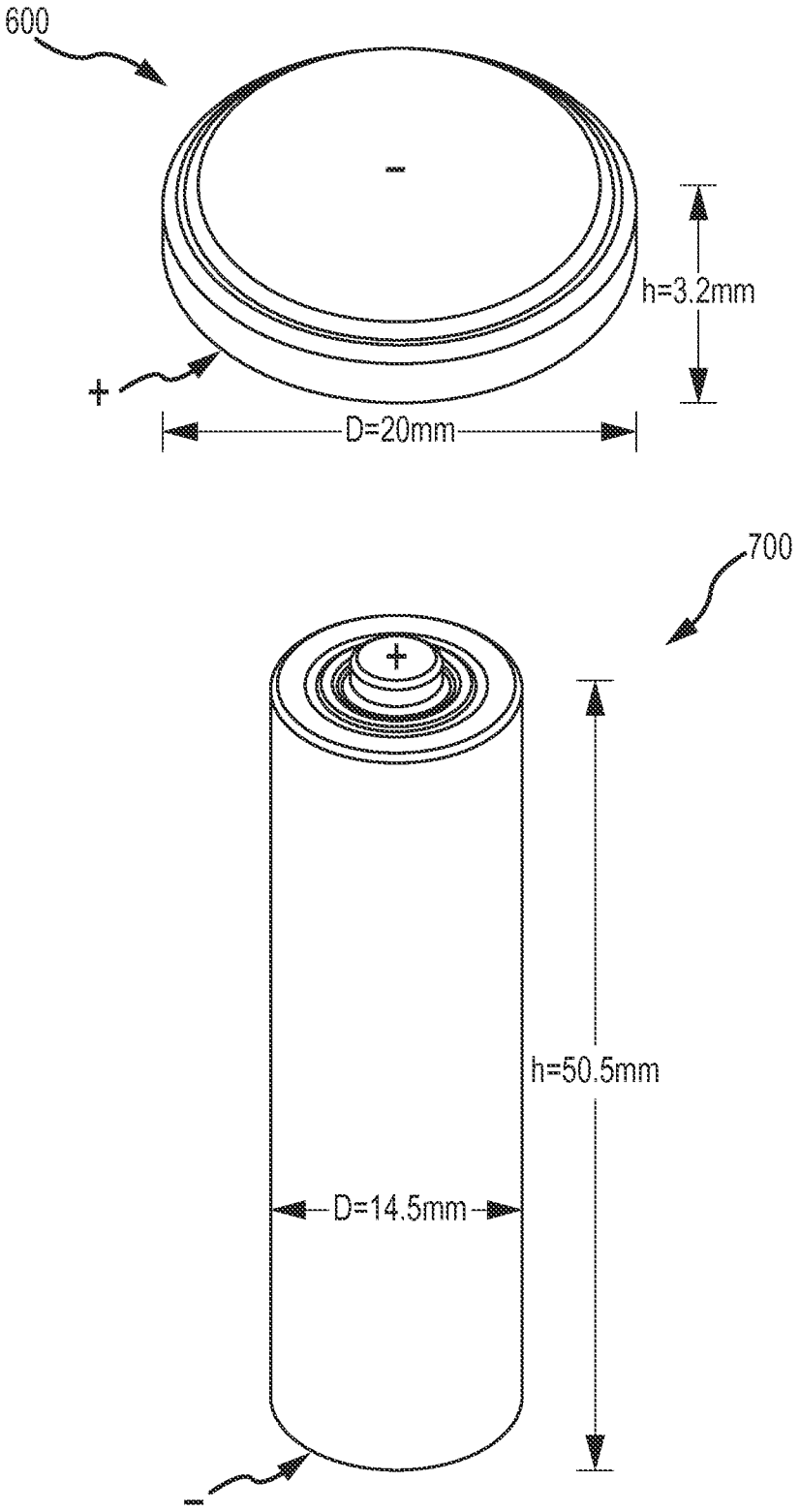
FIG. 10 depicts a comparison of power sources.

FIG. 10 depicts two prior art commercially-available batteries, in this example, a CR2032 battery 600 and a AA battery 700. The form factors of these batteries can be defined by their respective sizes and contact surfaces. For example, the CR2032 battery 600 has a diameter D of about 20 mm and a height h of about 3.2 mm. The AA battery 700, on the other hand, has a diameter D of about 14.5 mm and a height h of about 50.5 mm. Thus, the form factors of these batteries 600, 700 are different, as would be the sizes and configurations of receptacles into which the batteries can be received. In that regard, if a recipient wishes to utilize a AA battery as a power source for a device that requires a CR2032 battery, an adapter configured having a form factor substantially similar to the CR2032 battery would be necessary, along with the battery unit housing and converter as described herein. The battery unit housing contains a receptacle to receive the AA battery. The adapter would also require a form factor that replicates the positive and negative contacts of the CR2032 battery to ensure proper operation.

This disclosure described some embodiments of the present technology with reference to the accompanying drawings, in which only some of the possible embodiments were shown. Other aspects can, however, be embodied in many different forms and should not be construed as limited to the embodiments set forth herein. Rather, these embodiments were provided so that this disclosure was thorough and complete and fully conveyed the scope of the possible embodiments to those skilled in the art.

Although specific embodiments were described herein, the scope of the technology is not limited to those specific embodiments. One skilled in the art will recognize other embodiments or improvements that are within the scope of the present technology. Therefore, the specific structure, acts, or media are disclosed only as illustrative embodiments. The scope of the technology is defined by the following claims and any equivalents therein.

What is claimed is:

1. An apparatus comprising:

a battery unit defining a battery unit receptacle for receiving a battery comprising a first form factor;

a cable extending from the battery unit; and an adapter connected to the cable, the adapter configured to be matingly received in a housing battery receptacle, wherein the housing battery receptacle is configured to matingly receive a battery comprising a second form factor;

wherein at least a portion of the adapter is shaped to mimic the form factor of a disposable battery.

* * * * *